United States Patent [19]

Schiel

[11] 4,416,730

[45] Nov. 22, 1983

[54] WIRE END SECTION OF A PAPER MAKING MACHINE

[75] Inventor: Christian Schiel, Heidenheim, Fed. Rep. of Germany

[73] Assignee: J. M. Voith GmbH, Fed. Rep. of Germany

[21] Appl. No.: 396,424

[22] Filed: Jul. 8, 1982

[30] Foreign Application Priority Data

Jul. 16, 1981 [DE] Fed. Rep. of Germany ..... 3128156

[51] Int. Cl.[3] ..... D21F 1/02; D21F 1/36

[52] U.S. Cl. ..... 162/264; 162/299; 162/300; 162/344

[58] Field of Search ..... 162/264, 273, 299, 300, 162/344, 352, 123, 212, 214, 317

[56] References Cited

U.S. PATENT DOCUMENTS 3,582,467 6/1971 Gustafson et al. ..... 162/303
4,234,382 11/1980 Schiel ..... 162/301 X
4,308,097 12/1981 Schiel ..... 162/317 X

FOREIGN PATENT DOCUMENTS

WO80/02575 11/1980 PCT Int'l Appl. .

*Primary Examiner*—Richard V. Fisher

*Attorney, Agent, or Firm*—Ostrolenk, Faber, Gerb & Soffen

[57] ABSTRACT

The disclosure concerns the wire end section of a paper making machine. The wire belt is an endless loop and the pulp suspension is supplied by one or more head boxes. The head box has an upstream and a downstream flow guide wall defining a pulp outlet opening between them. The downstream guide wall has a convexly curved slide shoe which cooperates with the passing wire belt to define a web-forming zone. At the other side of the wire belt, upstream of the outlet opening, another convexly curved wire support surface is defined for leading the wire belt into the web-forming zone. Both of the convexly curved surfaces are displaceable transversely to the direction of pulp flow from the head box. The radius of curvature of the slide shoe is greater at the outlet opening and smaller away from the outlet opening. The radius of curvature of the cooperating supporting surface on the other side of the belt is smaller than the mean radius of curvature of the slide shoe. Where a plurality of head boxes are provided, drainage water from one head box is collected and is pumped to supply water for the other head box, and vice-versa.

38 Claims, 4 Drawing Figures

WIRE END SECTION OF A PAPER MAKING MACHINE

BACKGROUND AND SUMMARY OF THE INVENTION

The present invention relates to the the wire end section of a paper making machine, and more particularly to the cooperation between the head boxes and the wire belt or wire at the wire end section.

That section of the machine has a wire belt or wire, usually in the form of an endless belt that is driven and guided over guide rollers. There is at least one head box for supplying pulp suspension to the wire. The head box includes a channel that is defined between two guide walls, one wall more upstream in the direction of movement of the wire and one more downstream, and the channel terminates in an outlet opening through which a stream of pulp suspension is fed to the wire. One of the two flow guide walls, and particularly the downstream one, has an extension at its end closer to the wire which defines a convexly curved slide shoe which the wire moves past. The curved slide shoe cooperates with the wire passing it to define a web forming zone through which the pulp is moved. The pulp suspension is drained of water through the wire.

One such arrangement is known from German Provisonal Patent Auslegeschrift 29 08 791 published Dec. 18, 1980, which corresponds to U.S. Pat. No. 4,308,097. Before the endless wire belt, which carries the web of fiber that is being formed, travels over the curved continuation of the first flow-guide wall of the head box, it is guided over the outside of the other flow-guide wall of the head box.

One disadvantage of this arrangement is that the channel which is defined by the two flow-guide walls must have a relatively sharp deflection in the vicinity of the outlet opening. Stated in other words, the central flow thread of the stream of pulp has a smaller radius of curvature in the region of the outlet opening from the head box than in the web-forming zone. As a result, there is a danger that with high operating speeds, secondary flows will be produced in the web-forming zone which will move transversely to the direction of the main suspension flow, as seen in longitudinal section. These secondary flows can lead to a non-homogeneous distribution of the fibers. Furthermore, in extreme cases, cavitation phenomena occur.

Another disadvantage is that if a plurality of head boxes, arranged one behind the other, are associated with the wire belt for producing a multi-ply web, it is necessary to transfer the first layer of the fiber web onto a felt belt after that fiber layer has been formed. The wire belt must thereafter be led to the second head box, whereupon a layer of the fiber web formed there must again be transferred to the felt belt. This may be repeated several times. In this case, the head boxes must be arranged in a very narrow spaces between the wire belt on the one hand and the felt belt on the other hand. Therefore, as a rule, it is necessary to refrain from using the well-proven nozzle-like head box construction and to instead provide a "folded" flow channel.

The object of the present invention is further to develop the known arrangement so that a fiber web of high quality, i.e with a homogeneous distribution of the fibers, can be produced, even with extremely high speeds of travel of the wire.

This object is achieved by the slide shoe being located beyond the outlet opening of the head box toward the wire belt and downstream of the outlet opening with respect to the movement of the wire belt. The slide shoe includes a generally convexly curved first guide surface, which curves gradually from being oriented more transversely to the path of the wire belt past the head box at the outlet opening to being oriented more parallel to that path nearer the belt and further downstream from the outlet opening in the movement of the belt. The first guide surface cooperates with the belt to define a web-forming zone in which a web of the pulp suspension becomes formed. The radius of curvature of the convex first guide surface changes. In the region of the outlet opening from the head box, this radius is at least as large as the radius of curvature of the guide surface further downstream along the path of the wire belt, and preferably larger.

Additionally, there is a supporting device at the opposite surface of the wire belt from the head box and this supporting device includes its own convexly curved second guide surface for engaging the opposite surface of the wire belt. The second guide surface is also curved gradually, from being more parallel to the path of the wire belt to being more transverse to that path downstream in the path of the wire belt. The second guide surface is located in the vicinity of the outlet opening, but upstream of the first guide surface in the path of the wire belt, so as to introduce the wire belt into the web-forming zone. With the second guide surface, the wire belt is no longer supported by the outer side of the upstream one of the two flow-guide walls of the head box, for introducing the wire belt into the web-forming zone. Instead, the supporting device, with its convexly curved wire support surface, is arranged for this purpose within the loop of the wire belt. This has two benefits. Sufficient space is obtained in the vicinity of the outlet opening of the head box to assure the stable construction of the flow guide walls of the box, without the channel defined by the guide walls having to be substantially curved. The flow of fibrous pulp suspension can preferably be guided even without curvature and therefore substantially linearly. In this way, it is possible to avoid transverse flows, which would disturb the homogeneity of the web of fibers being formed.

It is now also possible to introduce the wire belt, together with a web of fibers previously formed on the wire belt, into the web-forming zone of an additional head box. In this way, as is known from other multi-ply paper making machines (German Unexamined Application for Patent Offenlegungsschrift 25 52 485 published June 2, 1977, FIG. 4), a second layer of a fiber web can be formed directly on the web layer which is already present on the wire belt. As is known, the first layer of fiber web, which is alredy present on the wire belt, serves as a filter-aid layer during removal of water from the additional layer through the wire belt, so that fewer fines and fillers are discharged together with the drainage water or backwater. In addition, there is no longer any space limits due to a felt belt having to cooperate with the arrangement of the head boxes. Therefore, use can be made, for instance, of well-proven nozzle head boxes.

German Provisional Patent Auslegeschrift No. 19 31 686 published Feb. 26, 1970, corresponding to U.S. Pat. No. 3,582,467, shows a drainage box, having a convexly curved wire guide surface and the drainage box is located within a wire belt loop, which is within the region of the outlet opening of a head box. The drainage box is swingable toward the outlet opening of the head box or away from it.

The drainage box has a plurality of bars extending transversly to the direction of travel of the wire. Drainage slits are present between these bars. However, such a drainage box has the disadvantage, particularly when it is arranged directly at the beginning of the web-forming zone, that it causes a non-uniform distribution of the fibers in the web of paper and a high loss of fines and fillers. Furthermore, the aforesaid German patent concerns a two-wire paper making machine. There is a high structural expense for providing two wire belts. Furthermore, a far greater amount of energy is required for driving two wire belts and a greater expense is incurred for cleaning them. In many two-wire paper making machines, the formation of the web is also disturbed because there is a long free jet of pulp between the outlet opening of the head box and the web-forming zone. To avoid this disadvantage, according to German Provisional Patent Auslegeschrift No. 1 931 686, it is necessary to provide flexible flow guide walls, which rest against the wire belts. According to the present invention, this disadvantage is avoided from the outset in that the jet of pulp is guided in any event on one side, without interruption, by the extended flow-guide wall or slide shoe.

On the other or upstream side of the jet of pulp at the outlet opening, the free length of the wire belt can be kept particularly short by developing the wire belt supporting device that is within the wire-belt loop with its second guide surface having a radius of curvature which is less than 200 mm. and preferably even less than 100 mm., and so that the radius of curvature of the second guide surface of the wire supporting device is smaller than the means radius of curvature of the first guide surface of the slide shoe, which is at the opposite side of the wire belt and at the downstream side of the outlet opening. The wire belt supporting device with the convexly curved second guide surface comprises a simple, solid wire supporting rail which is free of drainage slits and has a radius of curvature which can be selected particularly small. As compared with a rotating roller, this construction has the advantage that it is not necessary to take critical speeds of rotation into consideration. The supporting device can therefore be shaped entirely independently of the speed of the machine.

In order to be able to counteract possible inaccuracies in the manufacture of the wire supporting rail inside the loop of the wire belt or of the adjacent flow guide wall of the head box, the wire supporting rail is displaceable as a whole transversely to the stream of pulp, in the direction toward the outlet opening of the head box or back. In addition, the path of displacement of this rail over the width of the wire belt can be preferably set at different values. For this purpose, a plurality of individually adjustable threaded spindles can be provided, for instance, over the width of the rail.

When the wire belt enters the web-forming zone, air may be introduced into the stream of pulp. This air disturbs the web-forming process. This danger is counteracted by providing the wire support rail that is typically within the wire belt loop with a downstream run-off line which is located upstream along the path of movement of the wire belt from the place along the path of the belt where the stream of pulp exiting from the channel at the head box impinges on the belt. The air present in the meshes of the wire belt, behind the line at which the wire belt runs off from the wire belt support rail, can escape from the meshes into the inside of the wire belt loop upon the impingement of the jet of pulp against the wire belt.

French Unexamined Application for Pat. No. 2 457 340 published Dec. 9, 1980 (W080/02575 published Nov. 27, 1982 as an International Application under PCT) shows a wire end section of a paper making machine in which a wire belt is guided in the web-forming zone over a suction box. The suction box has a wire support rail only at the inlet end and at the outlet end. The vacuum in the suction box causes strong bending of the wire belt. In the web-forming zone, the stream of pulp is covered by a flexible lip, which is fastened to the upper flow-guide wall of the head box. This lip bends correspondingly to the bending of the wire belt. One disadvantage of this known construction is that a large amount of energy is required to produce the vacuum in the suction box. Another disadvantage is that the flexible lip can enter into oscillation. This generally produces large variations in the weight per unit of surface of the paper web produced. Furthermore, there is a danger of paper web breakage. In addition, the course of a curvature of the web-forming zone can be controlled at most by changing the tension of the wire or the vacuum. The invention, on the other hand, makes it possible for a given course of the curvature to be precisely determined at the stationary slide shoe that is downstream of the head box, both in the direction of travel of the wire belt, and also transversely thereto, for instance at the edges.

The curved slide shoe of the invention can be developed as a rigid extension of the associated flow-guide wall. However, the slide shoe is preferably transversely displaceable to the flow of pulp. Preferably, there is a sealing surface which is located between the immovable, downstream flow guide wall and the relatively displaceable slide shoe. If necessary, the slide shoe can be moved to extend slightly into the pulp channel. This enables the size of the outlet opening to be adjusted in order to change the quantity of pulp that emerges. The slide shoe is adjustable so that its path of displacement over the width of the wire belt is adjustable to different extents. As a result, the stream of pulp can be made uniform over the width of the machine. Placing the sealing surface, which cooperates with the slide shoe, in front of the outlet opening, with respect to the direction of flow of the pulp suspension helps to stabilize the stream of pulp in the outlet opening.

Because the radius of curvature of the slide shoe increases in the direction of flow of pulp, it is possible to take into account the fact that the removal of the water takes place faster at the beginning of the web-forming zone than at the downstream end. In this case, therefore, the wire belt is of approximately constant curvature in the drainage zone. However, it may also be advisable, particularly in the case where high homogeneity is required of the sheet to be formed, to cause the curvature of the slide shoe in the direction of flow to decrease for decreasing the pressure in the direction of flow, which compensates for the friction on the slide shoe. The mean radius of curvature of the slide shoe is generally between 100 and 800 mm and preferably between 150 and 300 mm.

In order precisely to define the end of the drainage and web forming zine, the wire belt should preferably be deflected slightly, at most by 5°, by a run-off edge provided at the end of the slide shoe, i.e. it is deflected from being tangent to the slide shoe at the run-off edge.

For furthr removal of water from the fiber web being formed, a pressure chamber is developed downstream of the slide shoe, with respect to the path of the wire belt and upstream of throttle means which are located near, but out of contact with, the wire belt. The air pressure in this chamber should in general be between 5,000 and 10,000 pascals, and preferably between 2,000 and 7,000 pascals.

If a multi-ply sheet of fibers is to be produced, several, for instance two, head boxes are arranged behind one another at the same surface of the wire belt in such a manner that at least one second layer of fiber web produced from the second head box is formed on a first layer of the fiber web produced from the first head box. As already mentioned above, the first layer of fiber web serves here as a filter-aid layer for the removal of water from the second fiber web layer. By this process, there is a higher retention of fines and fillers. Each of the head boxes has a respective slide shoe at its downstream flow guide wall. The length of the arc of that slide shoe, measured in the direction of flow and of movement of the wire belt, is larger for each succeeding head box in the direction of travel of the wire belt. Correspondingly, the mean radius of curvature of each slide shoe becomes progressively smaller with each succeeding head box.

Higher retention of fines and fillers upon the drainage of the first layer of fiber web is a further object of the invention. To achieve this, there is a separate drainage water or backwater recovery system for each head box. The drainage water from each of the head boxes is collected in a respective collection reservoir. The drainage water from the first head box is pumped to the pulp dispensing channel of the second head box, while the drainage water from the second head box is pumped to the pulp dispensing channel of the first head box. With a wire end section having two head boxes, the drainage or backwater coming from the first head box and having a relatively high proportion of fines and fillers, is used to dilute the pulp for the second head box. In this way, a large part of the fines and fillers, which are "lost" after drainage of water from the pulp from the first head box, still pass into the paper web which is being formed. In constrast, in known paper making machines, there is a frequent problem in that the content of fines and fillers in the backwater of the first head box gradually becomes so great, particularly with certain types of waste paper as raw material, that desired quality of paper can no longer be obtained. A larger proportion of the backwater than should otherwise be necessary must then be withdrawn from the circuit. As a result, the filter system of the conventional paper factory is subjected to a heavier load. All of these disadvantages can be eliminted with the above described features. This is best done if, in the above-indicated example with two head boxes, approximately equal amounts of backwater are produced in the two web-forming zones. Therefore, provision should be made for any excess backwater to be able to flow from the one backwater collection system into the other.

Illustrative embodiments of the invention will be described below with reference to the accompanying drawings.

DESCRIPTION OF THE PREFERRED EMBODIMENTS

Figure 1:
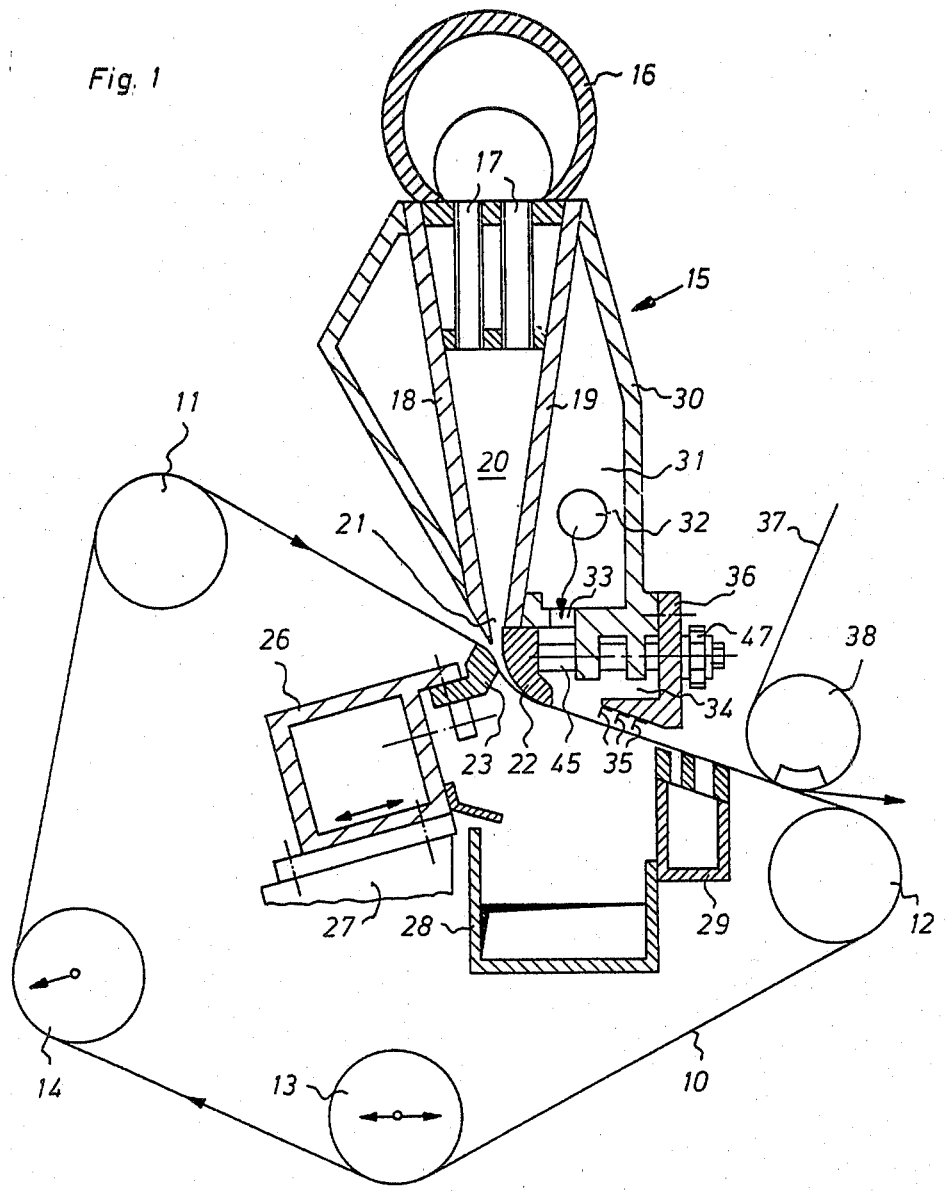
FIG. 1 is a diagrammatic, longitudinal, cross-sectional view through the wire end section of a paper making machine having one head box.

In a paper making machine, the wire end section shown in FIG. 1 comprises an endless wire belt or wire 10, which passes over spaced apart guide rollers 11 to 14 supported on a frame (not shown). One of the guide rollers is a regulating roller 13 and another is a tensioning roller 14. The wire belt is driven by one or more of its wire guide rollers. The tension of the wire belt should be in the customary range between 3 and 10 kN/m.

There is a head box 15. It and all of its below described parts (with obvious exceptions) extend over the entire width of the head box 15. The head box comprises a transversely extending pulp suspension distributing pipe 16, a bank of tubes 17 extending from the pipe 16 in an array across the wire belt and communicating between the pipe 16 and the outlet channel 20, and the outlet channel 20, which is defined by two flow-guide walls 18 and 19 at the upstream and downstream sides of the channel 20. The channel 20 has an outlet opening 21.

The downstream flow-guide wall 19 has a continuation which extends beyond the outlet opening 21 in the direction of flow, and which is in the form of a slide shoe 22 with a first convexly curved guide surface. The wire belt 10 moves over the bottom outlet edge portion of the shoe 22.

In the region of and just upstream of the outlet opening 21, the wire belt 10 is conducted over a stationary rail 23, which is arranged within the loop of the wire belt 10. The rail 23 has a convexly curved wire supporting second guide surface 24 shown in FIG. 2.

The jet of pulp suspension emerging from the outlet opening 21 passes into a tapered web formation zone 25 at the wire belt 10. This zone is curved in a manner corresponding to the slide shoe 22, and the zone narrows downstream of the outlet opening 21. In this way, intensive removal of water occurs through the wire belt and toward the inside of the loop of the wire belt.

The rail 23 is fastened to a cross member 26, which rests at each of its ends on a supporting pedestal 27. The cross 26 member is displaceable transversely to the direction of suspension flow within the web forming zone 25, i.e. toward or away from the outlet opening 21. A trough 28 receives the water drained from the web through the wire belt 10 at zone 25. For further draining water from the web of paper being formed, a suction box 29 may be provided downstream of the zone 25.

There is a stiffening wall 30 of the head box 15, which suppots the slide shoe 22. A hollow space 31 is defined between the wall 30 and the flow guide wall 19. Compressed air is fed to this hollow space through a connection 32. The air passes through a plurality of openings 33 into a pressure chamber 34 located behind or downstream of the slide shoe 22. The pressure chamber is closed toward the outside of a labyrinth formed of three baffles 35 downstream of the slide shoe. These baffles 35 are supported on a rail carrier 36, which is fastened to the stiffening wall 30 and they are held near but out of contact with the wire belt and the pulp thereon.

A felt belt 37 (or even another wire belt) passes over a suction pick-up roll 38, and removes the formed web of paper from the wire belt 10 and conducts it to further drainage and drying devices, not shown.

The fixed wire-support rail 23 can be made, for instance, of ceramic. It is fastened to a rail holder **23*b* by means of a clamping piece 23*a*. The rail holder 23*b* is connected by a plurality of screws 41, distributed across the width of the rail, to the transverse member 26. In addition, a plurality of threaded spindles 42 each having two nuts 43 on it, are provided on the transverse member, and distributed over its width. Each of the threaded spindles 42 extends through an eye 44 which is developed on the rail holder 23*b*. After the loosening of one of the screws 41, the rail holder 23*b*, together with the rail 23 can be brought closer to or further from the flow-guide wall 18 than the spacing of the rail in the region of the rest of the spindles 42. This is done by turning the respective nuts 43** on one spindle. This compensates for manufacturing tolerances.

After leaving the outlet opening 21, the jet of pulp suspension (dashed line 7 in FIG. 2) falls free for a short distance toward the facing side of the wire belt 10. The jet of pulp impinges at 8 upon the wire belt 10, which has previously left the rail 23 at 9.

In general, the distance between the rail 23 and the bottom end of the flow-guide wall 18 is adjusted to be as small as possible so that the length of the free jet of pulp, and therefore the distance from the outlet opening 21 up to the place 8 of impingement of the jet of pulp on the wire belt 10, is as small as pcssible. The radius of curvature k of the rail 23 is, as a rule, less than 100 mm, which also contributes to shortening the free jet of pulp.

The slide shoe 22 is fastened to a plurality of displacement bars 45 distributed over its width. The bars 45 lie in respective boreholes 46 in the stiffening wall 30 and are axially displaceable therein toward or away from the outlet opening 21. On each adjustment bar 45, an adjustment nut 47 is rotatably supported. The external thread of the nut engages a threaded borehole in the sealing-rail carrier 36. The adjustment nuts 47 can be turned individually. In this way, the path of displacement of the slide shoe 22 across the width of the machine can be adjusted to different values.

The upper end of the movable slide shoe 22 contacts the lower end of the flow-guide wall 19 at a sealing surface 48. In the direction of flow of suspension, the surface 48 is located above the end of the flow-guide wall 18 and therefore in front of the outlet opening 21. The clearance of the outlet opening 21 and thus the quantity of the emerging flow can be changed by displacing the slide shoe 22.

The curved surface of the slide shoe 22, which is contacted by the flow of pulp can advantageously be developed in the following manner. Within the region of the outlet opening 21, it is flat, or it is only slightly curved with a very large radius of curvature K. Adjoining this downstream is a region of relatively sharper curvature, with a radius of curvature r. Following this is a region with a lesser curvature, with a radius of curvature R, smaller than radius K, but larger than the radius r.

Figure 2:
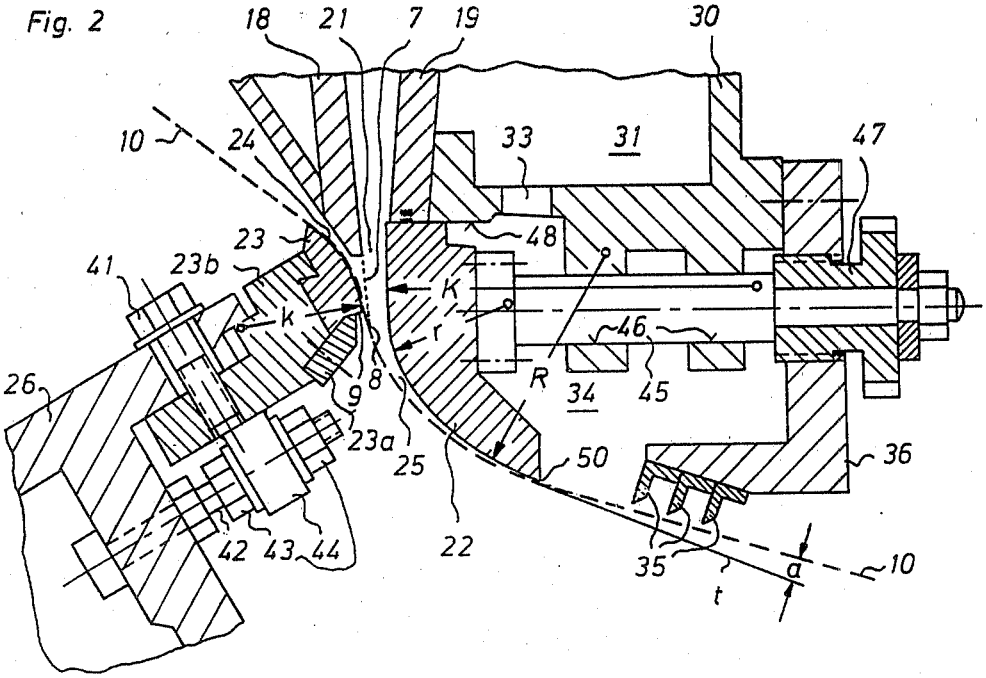
FIG. 2 shows a portion of FIG. 1 on a larger scale.

In FIG. 2, there is a sharp run-off edge 50 on the slide shoe 22. There is a tangent t which can be drawn to the curved surface of the slide surface at the run-off edge 50. The wire belt 10 is preferably guided to form an angle a of about 0.5° to 5° with the tangent t, measured with the machine being stationary and the wire belt 10 being taut.

Figure 3:
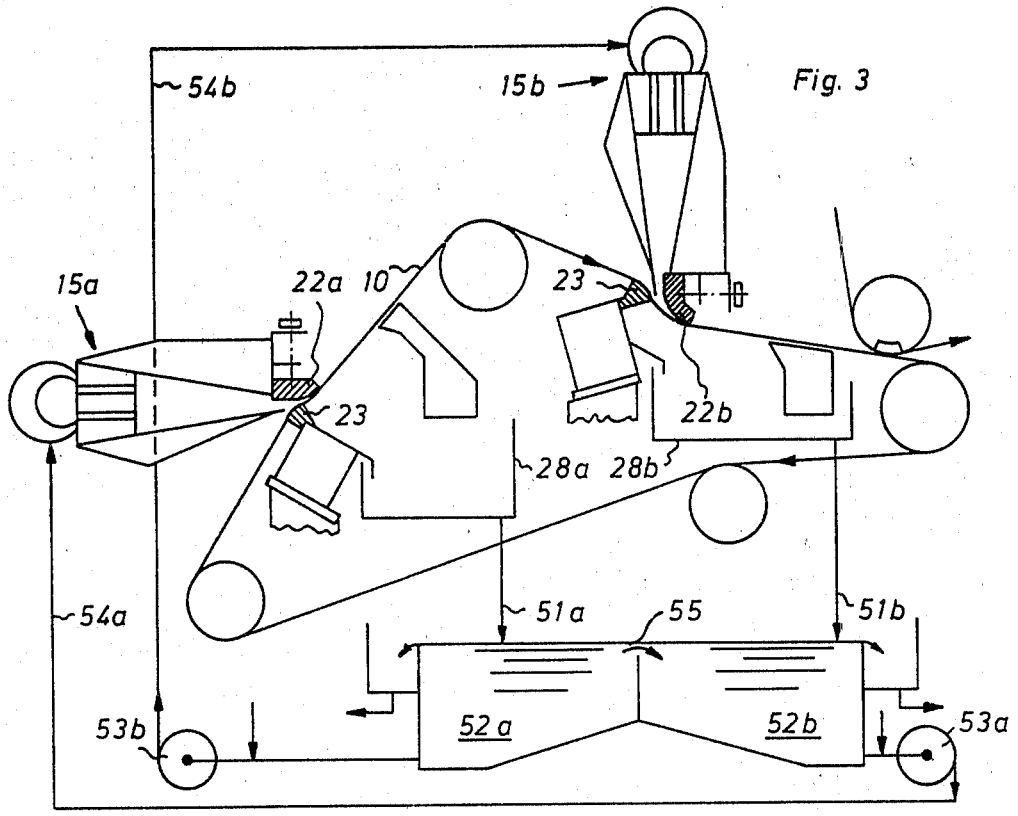
FIG. 3 is a diagrammatic, longitudinal, cross-sectional view through the wire end section of a paper making machine having two head boxes, and also showing the corresponding backwater circuits.

In FIG. 1, the head box 15 is arranged vertically, with its outlet opening 21 located at the bottom. However, any other position or orientation of the head box is also possible. FIG. 3 shows the wire end of a paper making machine having two head boxes. The first head box **15*a* is arranged horizontally, while the second head box 15*b* is arranged vertically, as in FIG. 1. The two head boxes 15*a* and 15*b* differ in having different slide shoes 22*a* and 22*b*, respectively. In the first horizontal head box 15*a*, the curved surface of the slide shoe 22*a* is relatively short and only slightly curved. Accordingly, the flow of pulp is deflected only by about 45° in the web-forming zone. At the second head box 15*b*, there is a higher resistance to drainage of water from the web, which results from the presence on the wire belt of the layer of fiber web that was formed at the first head box 15*a*. To compensate for this higher resistance to drainage, the slide shoe 22*b* of the second head box 15*b* has a longer curved surface of greater curvature than the slide shoe 22*a*. It is desired to obtain the smallest possible rate of drainage at the first head box 15*a* upon the formation of the first fiber web layer, and this is accomplished by the relatively large mean radius of curvature of the slide shoe 22*a*. In this way, the fibers of the pulp are less strongly washed into the wire meshes of the wire belt, so that the web of fibers can be more easily removed from the wire belt upon their deparature from the wire end section at a web removal means like 37, 38**. Furthermore, fewer fines and fillers are passed through the wire belt.

In FIG. 3, separate backwater or drainage water pans or collecting reservoirs **28*a* and 28*b* are associated with head head box 15*a* and 15*b*, respectively. From each of these pans, a respective backwater line 51*a* and 51*b* passes water into a respective backwater container 52*a* and 52*b*. As described above, during further operation, the collected backwaters from the two head boxes are interchanged for subsequent use. The circulating pump 53*a*, which pumps water to the first head box 15*a*, is connected on its suction side via the conduit 54*a* to the backwater pan 52*b*, while the other circulating pump 53*b*, which pumps water to the second head box 15*b*, is connected on its suction side via the pressure conduit 54*b* to the backwater pan 52*a*. There is a connection at 55 between the two backwater pans. Thus, some of the backwater which has entered the pan 52*a* and is not required by the pump 53*b* can flow over into the pan 52*b*. The sealing baffle carriers 36 of FIGS. 1 and 2** are present for each head box, but are not illustrated.

Figure 4:
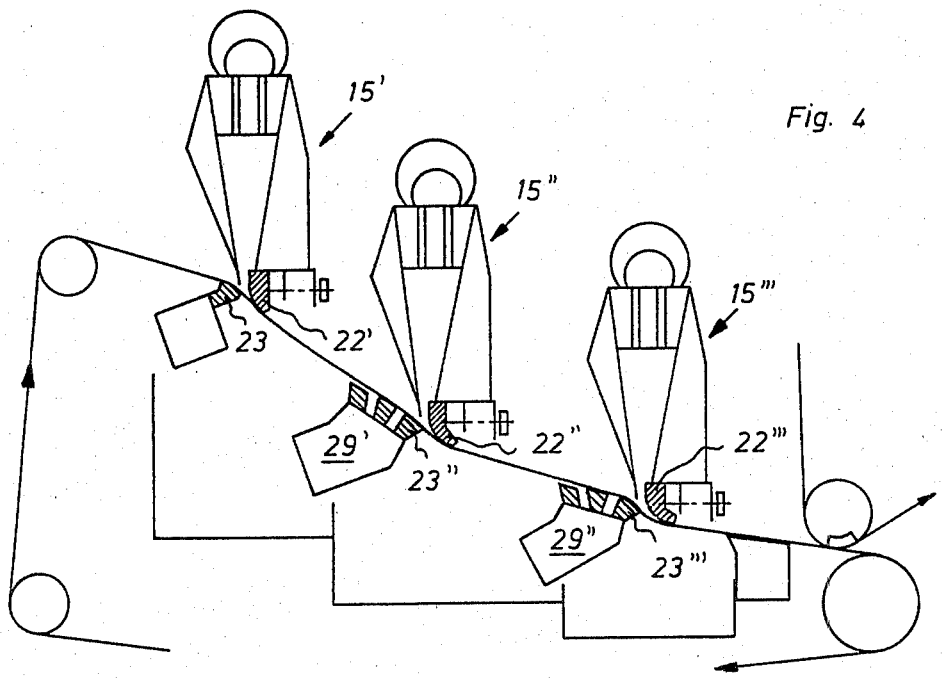
FIG. 4 is a diagrammatic, longitudinal, cross-sectional view through the wire end section of such machine having three head boxes.

FIG. 4 shows the wire end section of a paper making machine adapted for producing a three-layer fiber web. The three head boxes 15', 15'' and 15''' are again identical, except for their differently shaped respective slide shoes 22', 22'' and 22''' which have the size and shape characteristics described above for slide shoes **22*a* and 22*b*. The baffle carriers 36 with the sealing baffles 35 present at the head boxes (see FIGS. 1 and 2) have also not been shown in FIG. 4. It is obvious that the baffle carriers must be adapted to the different inclinations of the wire belt. The stationary wire guide rails 23 which are associated with the head boxes 15'' and 15''' are not fastened to a separate transverse member but are instead fastened to the run-off end of the preceding suction boxes 29' and 29''** respectively. This reduces the structural expenses.

In FIGS. 3 and 4, the individual head boxes can be swingably mounted to the frame, so that they can be easily lifted from the wire belt and so that, if necessary, the machine can operate, for instance, with one head box less and without its respective slide shoe contacting the wire belt.

In all of the embodiments, the web of paper from the wire belt can be removed, not with the suction roller 38 of FIG. 1, but by means of a rail or smooth roller ("lick up") or a suction box or, finally, by means of a blow box.

In accordance with a further development of the invention, the wire end section of a paper making machine according to the invention can be combined with one of the known sheet-forming units, for instance, with a traditional flat wire end or a suction head roll or with a twin-wire former. In this case a head box 15 of FIG. 1, or several of these, can preferably be arranged together with the parts 23 and 26 to 29 in front of the known sheet-forming unit in the direction of travel of the wire. With a twin-wire former, the head box of FIG. 1, inverted essentially with its direction of flow from the bottom to the top, could be arranged in front of the double wire zone on that wire belt which approaches the double wire zone in the direction from the bottom to the top.

Although the present invention has been described in connection with a plurality of embodiments thereof, many variations and modifications will now become apparent to those skilled in the art. It is preferred, therefore, that the present invention be limited not by the specific disclosure herein, but only by the appended claims.

What is claimed is:

1. A wire end section of a paper making machine, comprising:

a wire belt for receiving fibrous pulp suspension thereon and for permitting water drainage from the suspension through the wire belt; means for guiding and for driving the belt to move past a head box;

a head box for feeding pulp suspension to the wire belt; the head box including a first and a second flow guide wall, wherein the first guide wall is upstream in the movement of the wire belt past the head box and the second guide wall is downstream in the movement of the wire belt past the head box; both guide walls extending across the width dimension of the wire belt and extending above one surface of the wire belt; the guide walls defining a channel between them, and the channel having an outlet opening aimed for feeding pulp to the wire belt, whereby pulp travels through the channel to be fed through the outlet opening;

a slide shoe supported at the second guide wall and being located beyond the outlet opening of the head box and toward the wire belt; the slide shoe including a generally convexly curved first guide surface, which is curved gradually from being oriented more tranverse to the path of the wire belt past the head box to being oriented more parallel to that path nearer to the belt and further downstream in the movement of the belt; the first guide surface defining with the belt to a web forming zone for forming a web of the pulp suspension on the belt;

the first guide surface having a plurality of sections, including a first section in the region of the outlet opening and a second section in the region of the web-forming zone downstream along the path of the wire belt from the first section, the second section being curved more sharply than the first section;

a wire belt supporting device located at the opposite surface of the wire belt from the head box, and including a convexly curved second guide surface for engaging the opposite surface of the wire belt; the second guide surface being located in the vicinity of the outlet opening, upstream of the first guide surface in the path of the wire belt, for introducing the wire belt into the web-forming zone.

2. The wire end section of claim 1, wherein the second guide surface has a radius of curvature less than 200 mm.

3. The wire end section of claim 2, wherein the second guide surface has a radius of curvature less than 100 mm.

4. The wire end section of claim 2, wherein the wire belt supporting device is displaceably supported for movement transversely to the flow of pulp from the outlet opening; and the displaceable support permits the displacement of the supporting device to be adjusted to different extents at places across the width of the wire belt.

5. The wire end section of claim 4, further comprising a second one of the head boxes above the one surface of the wire belt and located downstream along the path of the wire belt from the first-mentioned head box.

6. The wire end section of claim 1, wherein the wire belt supporting device is displaceably supported for movement transversely to the flow of pulp from the outlet opening.

7. The wire end section of claim 6, wherein the displaceable support permits the displacement of the supporting device to be adjusted to different extents at places across the width of the wire belt.

8. The wire end section of claim 7, wherein the slide shoe is displaceably supported for displacement transversely to the flow of pulp from the outlet opening, and the displacement of the slide shoe can be adjusted to different extents at places across the width of the wire belt.

9. The wire end section of claim 7, wherein the second guide surface includes a run-off line, at which the wire belt separates from the second guide surface, and the run-off line of the second guide surface being located, along the path of the wire belt, upstream of the location on the wire belt on which pulp from the outlet opening impinges.

10. The wire end section of claim 1, wherein the second guide surface includes a run-off line, at which the wire belt separates from the second guide surface, and the run-off line of the second guide surface being located, along the path of the wire belt, upstream of the location on the wire belt on which pulp from the outlet opening impinges.

11. The wire end section of claim 10, wherein the slide shoe is displaceably supported for displacement transversely to the flow of pulp from the outlet opening.

12. The wire end section of claim 11, wherein the displaceable support of the slide shoe permits the displacement of the slide shoe to be adjusted to different extents at places across the width of the wire belt.

13. The wire end section of claim 1, wherein the slide shoe is displaceably supported for displacement transversely to the flow of pulp from the outlet opening.

14. The wire end section of claim 1, further comprising a second one of the head boxes above the one surface of the wire belt and located downstream along the path of the wire belt from the first-mentioned head box;

a first drainage water recapture system for collecting the drainage water that drains through the wire belt out of the pulp from the first head box, and a second drainage water recapture system for collecting the drainage water that drains through the wire belt out of the pulp from the second head box;

each recapture system comprising a respective collecting reservoir for drainage water from the wire belt in the vicinity of the respective head box and a respective pump for pumping drainage water from that reservoir to one of the head boxes; the reservoir and the pump for the first head box being connected for pumping water to the channel of the second head box, and the reservoir and pump for the second head box being connected for pumping water to the channel of the first head box.

15. The wire end section of claim 13, wherein the slide shoe is displaceably supported at the second flow guide wall, and the second flow guide wall supports a sealing surface at which and with respect to which the slide shoe is displaced.

16. The wire end section of claim 15, wherein the displaceable support of the slide shoe permits the displacement of the slide shoe to be adjusted to different extents at places across the width of the wire belt.

17. The wire end section of claim 16, wherein the sealing surface is located in front of the outlet opening in the direction of the pulp flow.

18. The wire end section of claim 15, wherein the sealing surface is located in front of the outlet opening in the direction of pulp flow.

19. The wire end section of claim 13, wherein the displaceable support of the slide shoe permits the displacement of the slide shoe to be adjusted to different extents at places across the width of the wire belt.

20. The wire end section of claim 13, wherein the slide shoe has a run-off edge at which the wire belt separates from the slide shoe, and that run-off edge being shaped and positioned and the guide means for the belt also being shaped and positioned so that the wire belt is deflected a small angle from a tangent to the first guiding surface at the slide shoe run-off edge.

21. The wire end section of claim 1, wherein in the web-forming zone the radius of curvature of the first guide surface of the slide shoe increases along the path of wire belt movement.

22. The wire end section of claim 21, wherein the slide shoe has a run-off edge at which the wire belt separates from the slide shoe, and that run-off edge being shaped and positioned and the guide means for the belt also being shaped and positioned so that the wire belt is deflected a small angle from a tangent to the first guiding surface at the slide shoe run-off edge.

23. The wire end section of claim 1, wherein the slide shoe has a run-off edge at which the wire belt separates from the slide shoe, and that run-off edge being shaped and positioned and the guide means for the belt also being shaped and positioned so that the wire belt is deflected a small angle from a tangent to the first guiding surface at the slide shoe run-off edge.

24. The wire end section of claim 23, further comprising air flow throttle means disposed a distance along the wire belt from the run-off edge of the slide shoe, and located above the same surface of the wire belt as the slide shoe;

an air pressure chamber communicating with the wire belt between the slide shoe and the throttle means, wherein the chamber is generally sealed off at the wire belt by the slide shoe and by the throttle means, and the throttle means being spaced out of contact with the surface of the wire belt and the web thereon.

25. The wire end section of claim 1, further comprising air flow throttle means disposed a distance along the wire belt from the slide shoe, and located above the same surface of the wire belt as the slide shoe;

an air pressure chamber communicating with the wire belt between the slide shoe and the throttle means, wherein the chamber is generally sealed off at the wire belt by the slide shoe and by the throttle means and the throttle means being spaced out of contact with the surface of the wire belt and the web thereon.

26. The wire end section of claim 1, further comprising a second one of the head boxes above the one surface of the wire belt and located downstream along the path of the wire belt from the first mentioned head box.

27. The wire end section of claim 26, wherein the first guide surface of the second head box is of greater arcuate length than the first guide surface of the first head box.

28. The wire end section of claim 27, wherein the first guide surfaces of the first and second head boxes have respective mean radii of curvature and the mean radius of curvature of the first guide surface of the second head box is smaller than the mean radius of curvature of the first guide surface of the first head box.

29. The wire end section of claim 28, further comprising a suction box upstream of the second head box along the path of the wire belt and located above the opposite surface of the wire belt.

30. The wire end section of claim 29, wherein the suction box is at the upstream side of the first guide wall of the second head box.

31. The wire end section of claim 26, wherein the first guide surfaces of the first and second head boxes have respective mean radii of curvature and the mean radius of curvature of the first guide surface of the second head box is smaller than the mean radius of curvature of the first guide surface of the first head box.

32. The wire end section of claim 31, further comprising a suction box upstream of the second head box along the path of the wire belt and located above the opposite surface of the wire belt.

33. The wire end section of claim 32, wherein the suction box is at the upstream side of the first guide wall of the second head box.

34. The wire end section of either of claims 1, 13, 21, 23 or 28, wherein the first section of the first guide surface of the slide shoe has a radius of curvature that is at least as large as the radius of curvature of the second section.

35. The wire end section of claim 34, wherein the first section of the first guide surface has a radius of curvature which at most is large enough for the first section to be flat.

36. The wire end section of claim 34, wherein the first section of the first guide surface is curved.

37. A wire end section of a paper making machine, comprising:

a wire belt for receiving fibrous pulp suspension thereon and for permitting water drainage from the suspension through the wire belt; means for guiding and for driving the belt to move past head boxes;

a plurality of hed boxes arrayed along the wire belt, and each being for supplying pulp suspension to the wire belt; each head box including a first and a second flow guide wall, wherein the first guide wall is upstream in the movement of the wire belt past the head box and the second guide wall is downstream in the movement of the wire belt past the head box; the guide walls of each head box both extending across the width dimension of the wire belt and being above one surface of the wire belt; each of the guide walls of each head box defning a channel for that head box between those guide walls, and each channel having an outlet opening aimed for feeding pulp to the wire belt, wherein pulp travels through the channel to be fed through the outlet opening;

means in the vicinity of the outlet opening from each head box for guiding the wire belt past that outlet opening and for creating a web-forming zone on the wire belt past that outlet opening;

a first drainage water recapture system for collecting the drainage water from the first head box, and a second drainage water recapture system for collecting the drainage water from the second head box;

each respective system comprising a respective collecting reservoir for drainage water from the wire belt in the vicinity of the respective head box and a respective pump for pumping drainage water from that reservoir to one of the head boxes; the reservoir and the pump for the first head box being connected for pumping water to the channel of the second head box, and the reservoir and pump for the second head box being connected for pumping water to the channel of the first head box.

38. A wire end section of a paper making machine, comprising:

a head box for supplying pulp suspension to a wire belt to be moved past the head box; the head box including a first and a second flow guide wall, wherein the first guide wall is the wall that would be upstream in the movement of the wire belt past the head box and the second guide wall is the wall that would be downstream in the path of movement of the wire belt past the head box; the guide walls both extending a distance across the width dimension of the wire belt and extending above the wire belt; the guide walls defining a channel between them and the channel having an outlet opening aimed for feeding pulp out the outlet opening, wherein pulp travels through the channel to be fed through the outlet opening;

a slide shoe at the second guide wall and being located beyond the outlet opening and being located closer to where the wire belt would pass; the slide shoe including a generally convexly curved first guide surface which is curved gradually from more transverse to the path that the belt would follow past the head box to being more parallel to that path nearer to where the belt would pass and further downstream in the movement of the belt; and the first guide surface being for defining a web-forming zone together with a belt moving therepast;

the first guide surface having a plurality of curved sections, including a first section in the region of the outlet opening having a first radius of curvature, and a second section in the region of the web-forming zone downstream along the path of the wire belt from the first section, and the radius of curvature of the first section is at least as large as the radius of curvature of the second section;

a wire belt supporting device located to be at the opposite side of a wire belt that moves therepast from the head box; the wire belt supporting device including a convexly curved second guide surface for engaging the respective side of a wire belt moving therepast, and the second guide surface curving gradually from being more parallel to a wire belt moving therepast to being more transverse to the belt moving therepast downstream in the path of movement of a wire belt moving therepast; the second guide surface being located in the vicinity of the outlet opening, upstream of the first guide surface in the path of a wire belt, for introducing the wire belt into the web-forming zone.

* * * * *